US006011208A

United States Patent [19]

Hoshino

[11] Patent Number: 6,011,208

[45] Date of Patent: Jan. 4, 2000

[54] DRUM HOOP HOLDING DEVICE FOR A DRUM PEDAL

[75] Inventor: Yoshihiro Hoshino, Nagoya, Japan

[73] Assignee: Hoshino Gakki Kabushiki Kaisha, Japan

[21] Appl. No.: 09/228,137

[22] Filed: Jan. 11, 1999

[51] Int. Cl.[7] ..... G10D 13/02

[52] U.S. Cl. ..... 84/422.1

[58] Field of Search ..... 84/422.1, 422.2, 84/422.3

[56] References Cited

U.S. PATENT DOCUMENTS

| | | | |
|---|---|---|---|
| 4,186,644 | 2/1980 | Kurosaki | 84/422 R |
| 4,841,830 | 6/1989 | Yamashita | 84/1.14 |
| 5,574,237 | 11/1996 | Yanagisawa | 84/422.1 |

*Primary Examiner*—David Martin
*Assistant Examiner*—Kim Lockett
*Attorney, Agent, or Firm*—Ostrolenk, Faber, Gerb & Soffen, LLP

[57] ABSTRACT

The invention relates to a drum hoop holding device for a drum pedal, and the drum pedal includes a pivotal pedal plate. The holding device includes a hoop clamp body with a front part that supports a jaw that clamps the drum hoop against a support base of the pedal. The support base includes an inclined elastic material surface against which the hoop is clamped. The clamp body is oriented so that the front part is below the pedal while the rear part is laterally out from under the pedal. The clamp body has a hole through it, a spring that pushes the clamp body up, a bolt that passes through the hole with a seat atop the clamp body that receives the tightening nut and the curvature of the seat in the top of the clamp body cooperates with the curvature of the surface of the nut to permit orientation of the clamp body according to the thickness of the drum hoop to the clamp. A tightening bolt at the rear of the clamp body tightens the jaw at the front of the clamp body against the drum hoop.

15 Claims, 11 Drawing Sheets

FIG. 13 *PRIOR ART*
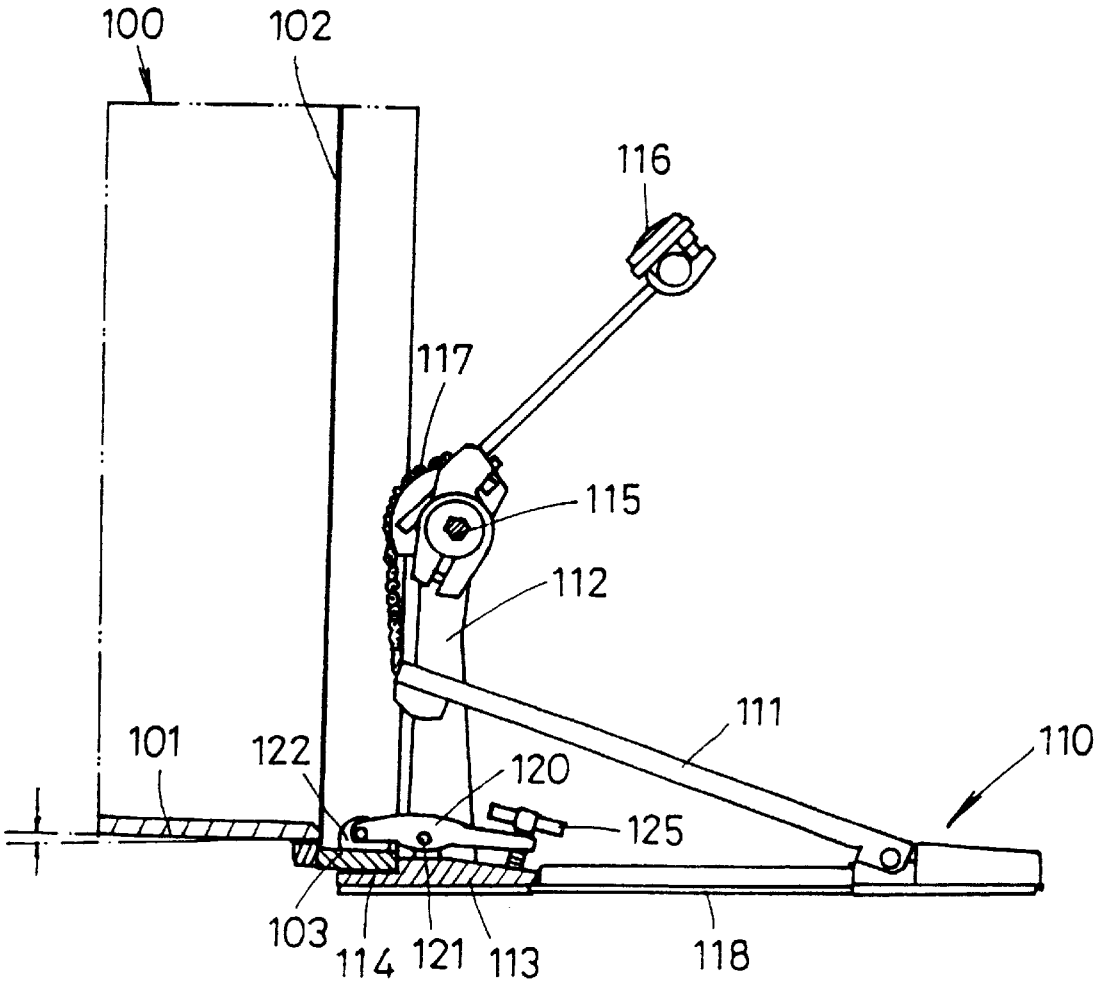

FIG. 14 *PRIOR ART*
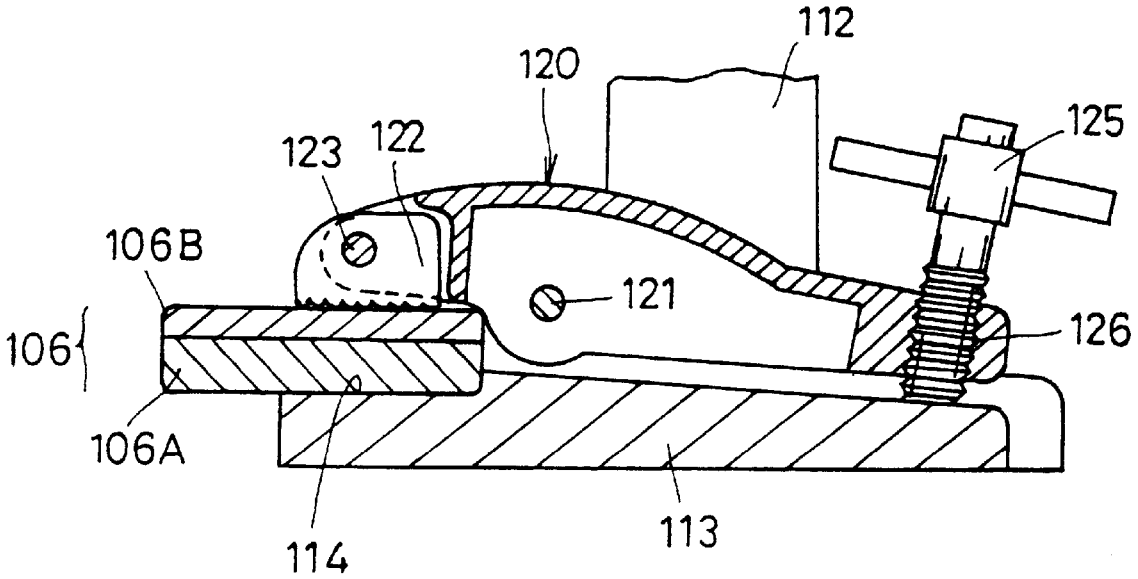
FIG. 15 *PRIOR ART*
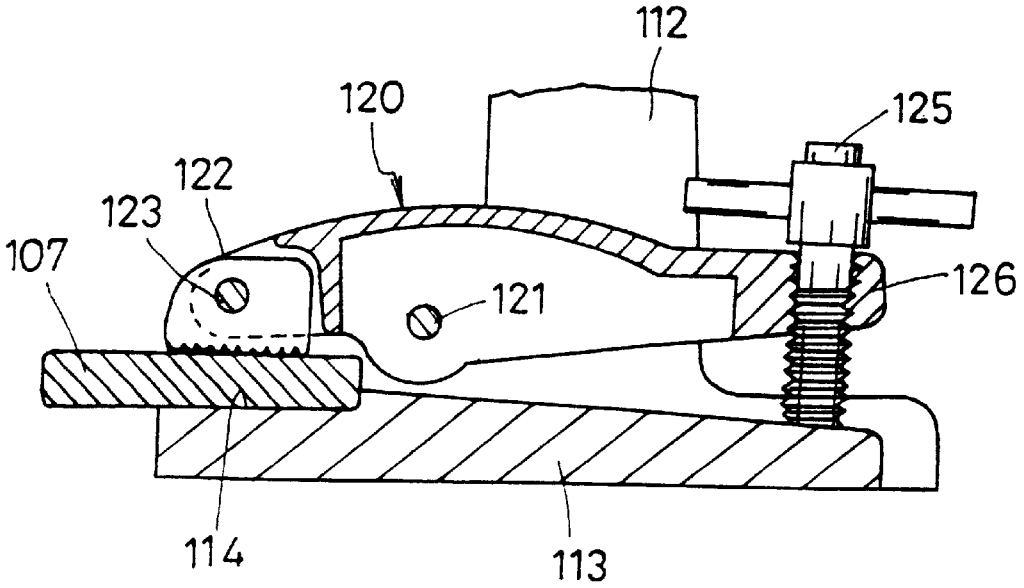

DRUM HOOP HOLDING DEVICE FOR A DRUM PEDAL

BACKGROUND OF THE INVENTION

This invention relates to a drum hoop holding device for a drum pedal.

PRIOR ART EMBODIMENT

An example of a hoop holding device for the hoop of a bass drum according to one prior art embodiment is shown in FIGS. 13 through 15. This structure is disclosed in the publication of Japanese Utility Model No. Hei 4-96794, which corresponds to U.S. Pat. No. 5,185,489. It includes a holding jaw 122 that presses the drum hoop 103 between the front part of the main hoop clamp body 120, which is freely rotatably supported in the front and rear directions through the shaft 121, and the drum hoop receiving part 114 at the front of the support base 113 of the drum pedal 110. A tightening bolt 125 fixes the main hoop claim body 120 by being screwed through the screw threaded opening in the rear part 126 (FIG. 14) of the main hoop claim body.

In addition, the holding jaw 122 is freely rotatably held in the front and rearward directions by a cross shaft 123 on which the jaw pivots.

The drum pedal 110 for beating on the drum head includes a pedal plate 111 supported on a pedal support 112. A rotary shaft 115 provided on the support 112 supports a rotary beater that has been installed on the rotary shaft 115. A cam 117 rotates the rotary shaft 115 through the chain that is connected for the up and down movement of the pedal plate 111.

A drum body 101 includes an end that is covered by a drum head. There may be a protective member 106B, such as a rubber sheet, etc., pasted to the main hoop body 106A for preventing possible damage to the hoop when the main hoop clamp body 120 engages the hoop 106, as shown in FIG. 14, for example. Such a hoop 106 has a large thickness, which causes the clamp volume of the main hoop clamp body to become heavy.

Many bass drums have thin hoops, like hoop 107 in FIG. 15. The thickness of the hoop 107 is substantially reduced, reducing the clamp volume of the main hoop clamp body 120.

The hoop holding device of prior art has been designed with the expectation that the clamp volume of the main hoop clamp body 120 will not be substantial. It has been difficult to completely clamp both a thick hoop 106 with a protective member 106B as described above which is pasted on and a thin hoop 107 made of metal.

As can be seen from the tightening position of the tightening bolt shown in FIGS. 14 and 15, moreover, it would be necessary to extend the length of the tightening bolt 125 in order to accommodate increased thickness of the hoop clamp. If the tightening bolt 125 is made longer, however, there is a danger that it may hit the pedal plate 111 reducing the operability of the pedal plate. In addition, the appearance of the pedal deteriorates.

As seen in FIG. 13, moreover, the bass drum 100 is ordinarily set so that its outward facing side (the side which is opposite to the drum pedal 110) has been slightly raised and inclined upward at the rear away from the pedal. This rear incline is set somewhat differently for different performers. When the bass drum is so inclined, its hoop 103 is also inclined. If an inclined hoop 103 is clamped between a flat hoop receiving part 114 and the main hoop clamp body 120, a twist develops in the hoop.

If the incline of the bass drum 100 is made large, the tip of the support base 113 is raised when the hoop 103 is clamped. If the performance is then continued, there are cases where the hoop 103 may bend or crack. Moreover, there are other cases where the base plate 118 of the drum pedal 110 may bend.

Further, the prior art hoop holding device is arranged immediately under the pedal plate 111 at the center of the front of the drum pedal 110 so as to face the front of the bass drum. To adjust the hoop holding device, therefore, it is necessary to operate the adjusting bolt 125 through hand groping, by a performer sticking his hand into a narrow space under the pedal plate 111. This is troublesome, tends to lower the operability, and sometimes makes it impossible to tighten the bolt firmly. In addition, the space for setting the hoop holding device is limited due to its relationship with the operation of the pedal plate 111, with a result that its design is restricted.

SUMMARY OF THE INVENTION

The object of the invention is to solve the problem of a hoop holding device for a drum pedal as described above. The invention provides an efficient device which is capable of firm clamping of the hoop irrespective of the thickness of the drum hoop and without extending the tightening bolt.

The invention provides a hoop holding device which is capable of firmly clamping the hoop without damaging the hoop or the base plate of the drum pedal, even when the bass drum has been set in an inclined state.

The invention further provides a hoop holding device which is easily firmly operable without having to operate the adjusting bolt in a groping manner by sticking a hand into a narrow space immediately under the pedal plate for adjustment and which is capable of free design in terms of mechanism and design without restrictions being placed on the setting space.

The invention relates to a hoop holding device for a drum pedal. There is a holding jaw that clamps a drum hoop between the front part of the main hoop clamp body, which is supported by the support base of the drum pedal, and the hoop receiving part on the front of the support base. A tightening bolt fixes the main hoop clamp body by being screwed through a screw opening in the main hoop clamp body, at the rear end thereof. A seat has a concave surface in the front and back directions. A through holding hole runs through the seat. Both the seat and the hole therein are formed approximately at the middle of the main hoop clamp body in the lengthwise direction. A support bolt runs through the through holding hole and is erected on the support base. A spring applies a continuous upward force to the seat and the support base. At the same time, the height adjustment of the main hoop clamp body against the support bolt is carried out in the front and rearward directions of the main hoop clamp body, irrespective of the angles, by an adjusting nut having a concave surface that is screwed to a support bolt that has been erected through the through holding hole and inserted into the concave surface of the seat that has been biased upwardly by the spring member.

A hoop holding device for a drum pedal includes a holding jaw that presses a drum hoop between the front of the main hoop clamp body that is supported by the support base of the drum pedal and the hoop receiving part on the front of the support base and includes a tightening bolt that fixes the main hoop clamp body. An inclined holding part for the hoop made of an elastic substance and has an inclined surface with a lower rear side and also a higher right side and left side, all formed at the hoop receiving part.

The hoop holding device includes a holding jaw that presses a drum hoop between the front of the main hoop clamp body that is supported by the support base of the drum pedal and the hoop receiving part on the front of the support base. A tightening bolt fixes the main hoop clamp body by being screwed through the main hoop clamp body at the rear. The front part of the main hoop clamp body is positioned at the front of the support base and the rear part of the main clamp body is positioned outside of the pedal plate and at the rear of the support base.

Furthermore, a hoop holding device comprises a main hoop clamp body including a front part located at the front of the support base and a rear part arranged outside the pedal plate at the rear of the support base. A seat having a concave surface in the front and rear directions approximately at the middle of the lengthwise directions has a through holding hole that runs through the seat. A screw hole is formed at the back. A hoop holding jaw is provided freely movably front and back, and also right and left, through the axial part at the lower part of the front of the main hoop clamp body. A support bolt extends through the holding hole of the main hoop clamp body at the support base. A spring between the base side of the seat of the main hoop clamp body and the support base provides upward bias to the seat at all times. An adjusting nut has a convex surface part that is screwed to the support bolt extending through the through holding hole and that is inserted into the concave surface part of the seat that is biased by the spring. A tightening bolt fixes the main hoop clamp body by being screwed into the screw hole at the rear of the main hoop clamp body.

The invention further relates to a hoop holding device for a drum pedal in which a rotation preventing part for setting the movement of the main clamp body in the inward direction of the foot pedal is formed on the main hoop clamp body. A stop engages the rotation-preventive part and is provided at the support base.

Other features and advantages of the present invention will become apparent from the following description of the invention which refers to the accompanying drawings.

BRIEF DESCRIPTION OF THE DRAWINGS

FIGS. 9 through 12 show components of the hoop holding device according to the invention;

FIG. 9 is a top view of the main hoop clamp body;

FIG. 10 show the adjusting nut wherein

FIG. 11 show the inclined holding part of the hoop receiving part wherein

FIG. 12 are cross-sections showing the hoop holding jaw of FIG. 3 wherein

FIG. 13 is a side view, partially in section, of a hoop holding structure of a drum pedal according to the prior art;

FIG. 14 is a cross-section of the conventional device clamping a thick drum hoop; and FIG. 15 is a cross-section of the conventional device clamping a thin drum hoop.

DESCRIPTION OF A PREFERRED EMBODIMENT

Figure 1:
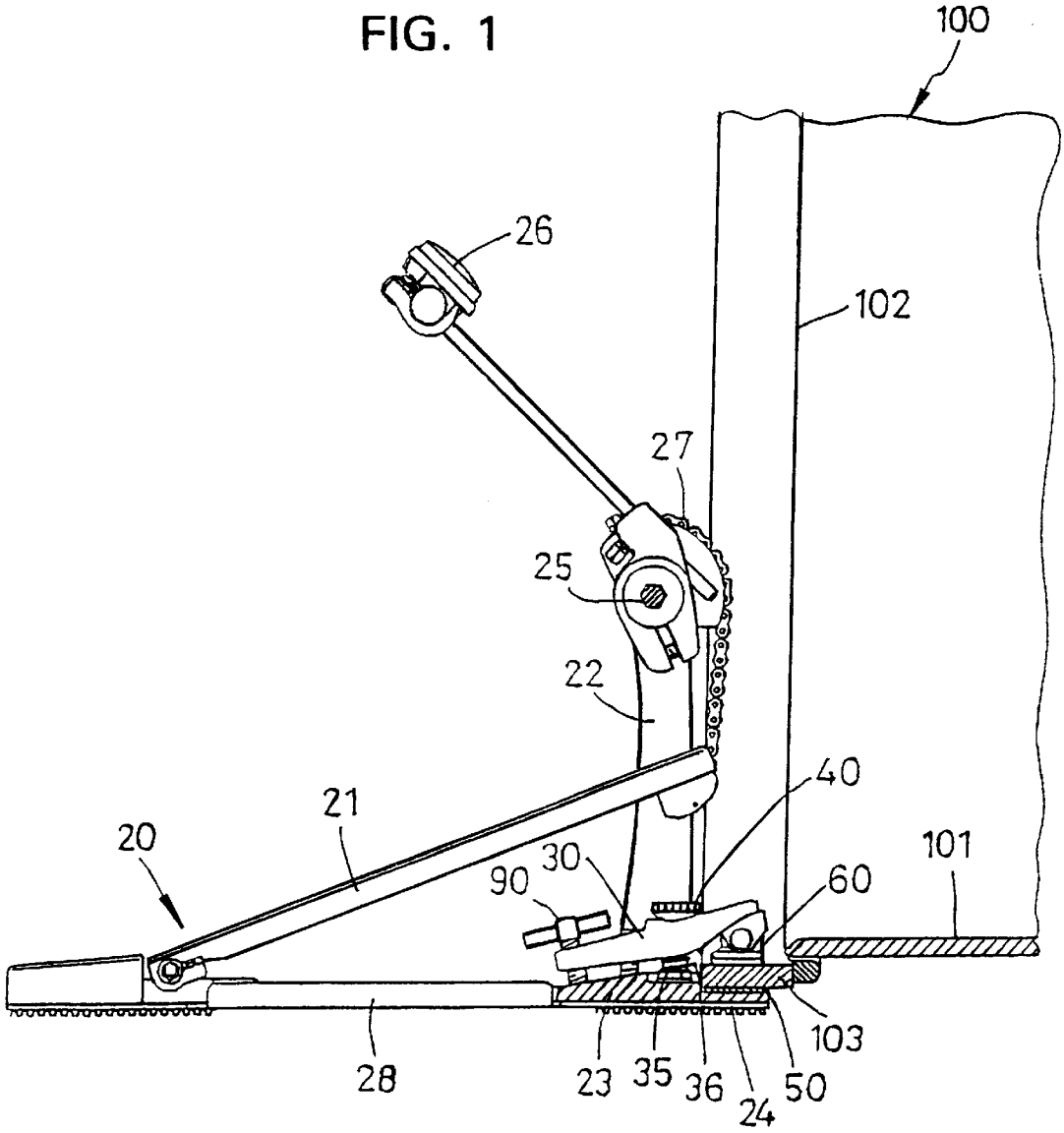
FIG. 1 is a side cross-sectional view showing a part of a drum pedal that includes the hoop holding device for the drum pedal according to this invention.

The bass drum 100 shown in FIG. 1 has a structure which is similar to that drum explained above in connection with FIG. 13, including a drum body 101, a drum head 102, and a drum hoop or rim around the body at the drum head.

In addition, the drum pedal 20 is also known and includes a pedal plate 21, a support 22 erected on a support base 23, a drum hoop receiver 24 for the front of the support base 23, a rotary shaft 25 for the support 22, a beater 26 installed on the rotary shaft 25, and a chain 27 for rotating the rotary shaft 25 by vertical swinging movement of the pedal plate 21.

The hoop holding device includes a holding jaw 60 that presses the drum hoop 103 against the hoop receiver 24 at the front of the support base 23. The jaw is on the front of the main hoop clamp body 30 that is supported on the support base of the drum pedal 20. A tightening bolt 90 is screwed through a screw receiving bore (FIG. 3) in the main hoop clamp body 30 for fixing the body.

Figure 9:
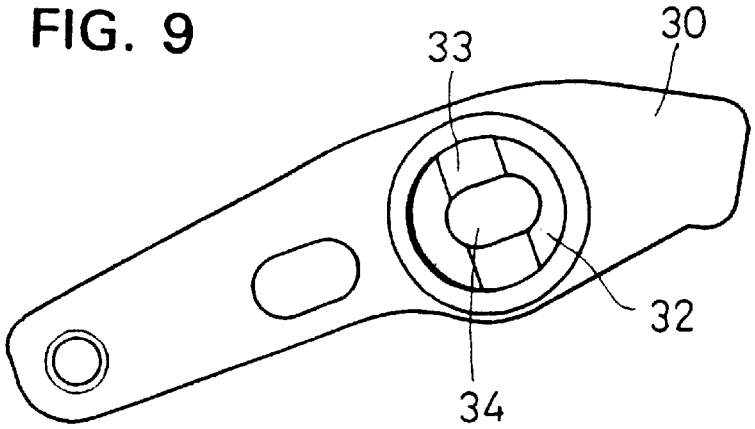

The support structure for the main hoop clamp body 30 in the hoop holding device includes a seat 32 having a concave surface in the front and rear direction in the lengthwise direction. The seat is approximately at the middle of the main hoop clamp body 30. A through holding hole 34 runs through the seat 32, as seen in FIGS. 3 and 4 and in FIG. 9.

Figure 3:
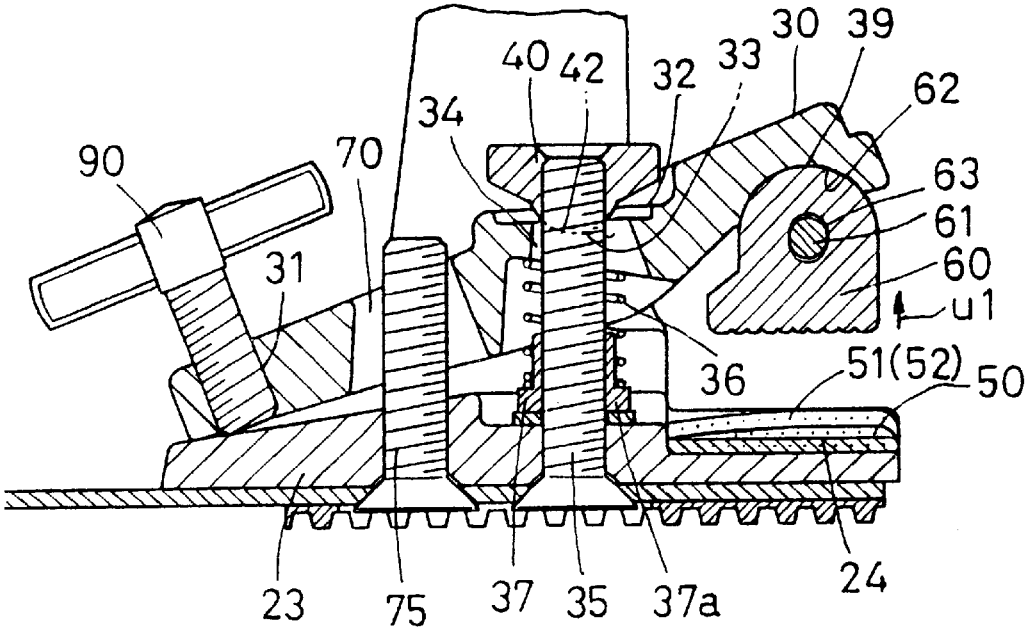
FIG. 3 is an expanded, side, cross-sectional view showing the state in which the front of the main hoop clamp body has been raised.
Figure 4:
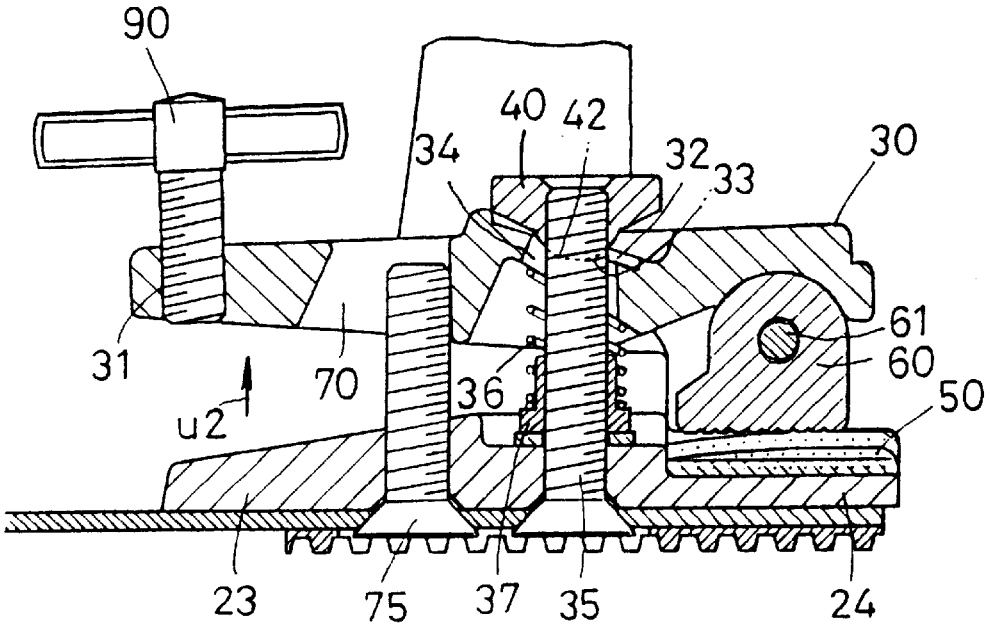
FIG. 4 is also an expanded, cross-sectional view showing the state in which the rear of the main hoop clamp body has been raised.

As seen in FIG. 3, a support bolt 35 extends through the through holding hole 34 and is erected on the support base 23. A spring 36 applies upward bias at all times to the seat 32 and is provided between the rear side of the seat 32 and the support base 23.

In FIG. 3, an installation nut 37 fixes the support bolt 35 to the support base 23. A spring receiver 37*a* for the spring 36 is formed at the installation nut.

Figure 10A:
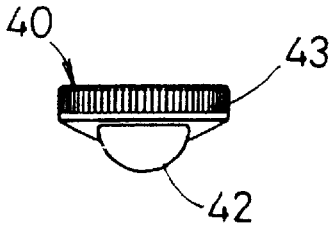
FIG. 10A is a one side view.
Figure 10B:
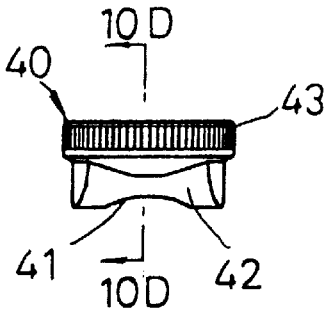
FIG. 10B is a view from another side.
Figure 10D:
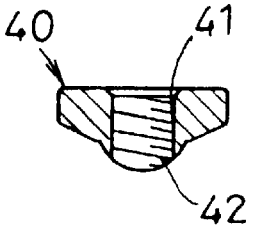
FIG. 10D is a cross-section on line D of FIG. 10B.
Figure 10C:
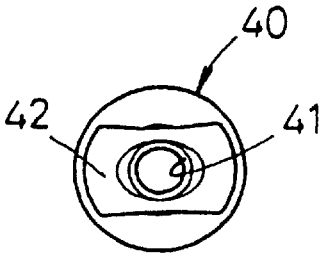
FIG. 10C is a bottom view.

An adjusting nut 40 (FIG. 10) is screwed onto the support bolt 35. The adjusting nut 40 has an internal screw thread 41 which is screwed on to the support bolt 35. The bottom of the nut 40 is a convex surface 42 that is inserted into the concave recess 33 of the hoop clamp seat 32 that has been biased by the spring member 36. The convex surface 42 of the adjusting nut 40 is formed as straight two partial spherical lobes with flat lateral exterior parts, as shown in FIGS. 10B and 10C. It is inserted, at each half rotation, into the concave recess 33 of the hoop clamp seat 32. The adjusting nut 40 has a rotation-grasping part 43.

The adjusting nut 40 is seated in the concave recess 33 in the front and back direction and is seated on the hoop clamp seat 32 and the convex recess 42 that is inserted into the said concave recess 33. It may be possible to carry out the height adjustment of the main hoop clamp body against the support bolt 35 at all angles in the front and rear directions.

FIG. 3 shows the front of the main hoop clamp body 30 upraised, as indicated by arrow mark u1. FIG. 4 shows the rear of the main hoop clamp body 30 upraised as indicated by arrow mark u2. In either state, the adjusting nut 40 rests against the hoop clamp seat 32 due to the bias of the spring 36.

Figure 5:
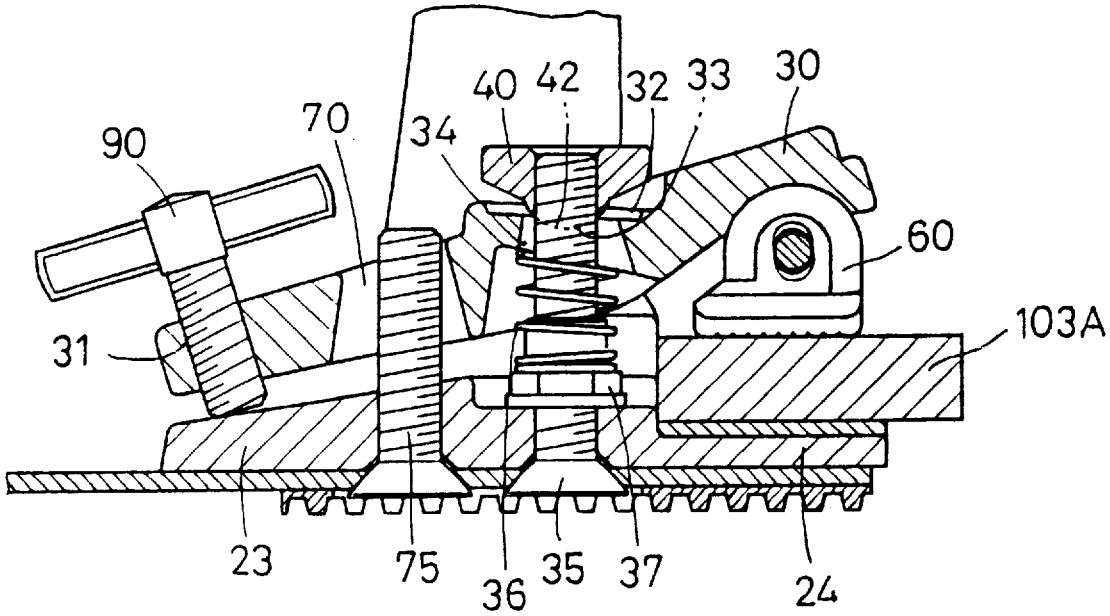
FIG. 5 is the same type of view of the hoop holding device clamping hoop having a large thickness.
Figure 6:
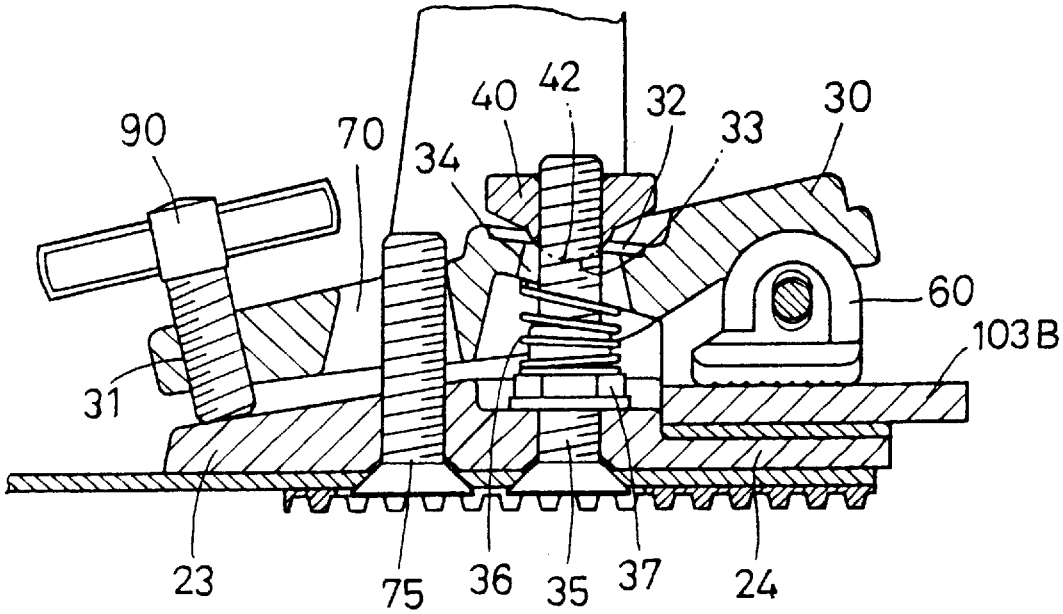
FIG. 6 is the same type of view of the hoop holding device clamping a hoop having a small thickness.

FIGS. 5 and 6 show the hoop holding device clamping a hoop with a large thickness 103A (FIG. 5) and a hoop with a small thickness 103B (FIG. 6). The main hoop clamp body 30 is capable of positional adjustment, around a transverse axis, at all angles in the front and rear directions, with respect to the support bolt 35, where the thicknesses of the hoops 103A and 103B that are to be clamped are quite different, when the position of the adjusting nut 40 is changed as compared with the position of the support bolt 35. This enables variations in the vertical position of the rear of the hoop clamp body 30 to be small. As a result, there is no need to increase the bolt length of the tightening bolt 90 that is screwed through the bore 31 at the rear of the main hoop clamp body 30, thereby producing firmer tightening and improved operability.

In the hoop holding device, the hoop 103 of the drum is clamped between the holding jaw 60 at the front of the main hoop clamp body 30 and the hoop receiving part 24 at the front of the support base 23, as explained above. As was explained above, according to prior art, the bass drum is often set in a rearwardly inclined state i.e., its top end is tilted toward the performer. This produces a possibility of a twisting phenomenon developing in the drum hoop 103 at the time of clamping, which may deform or damage the hoop 103 or the base plate 28.

Figure 7:
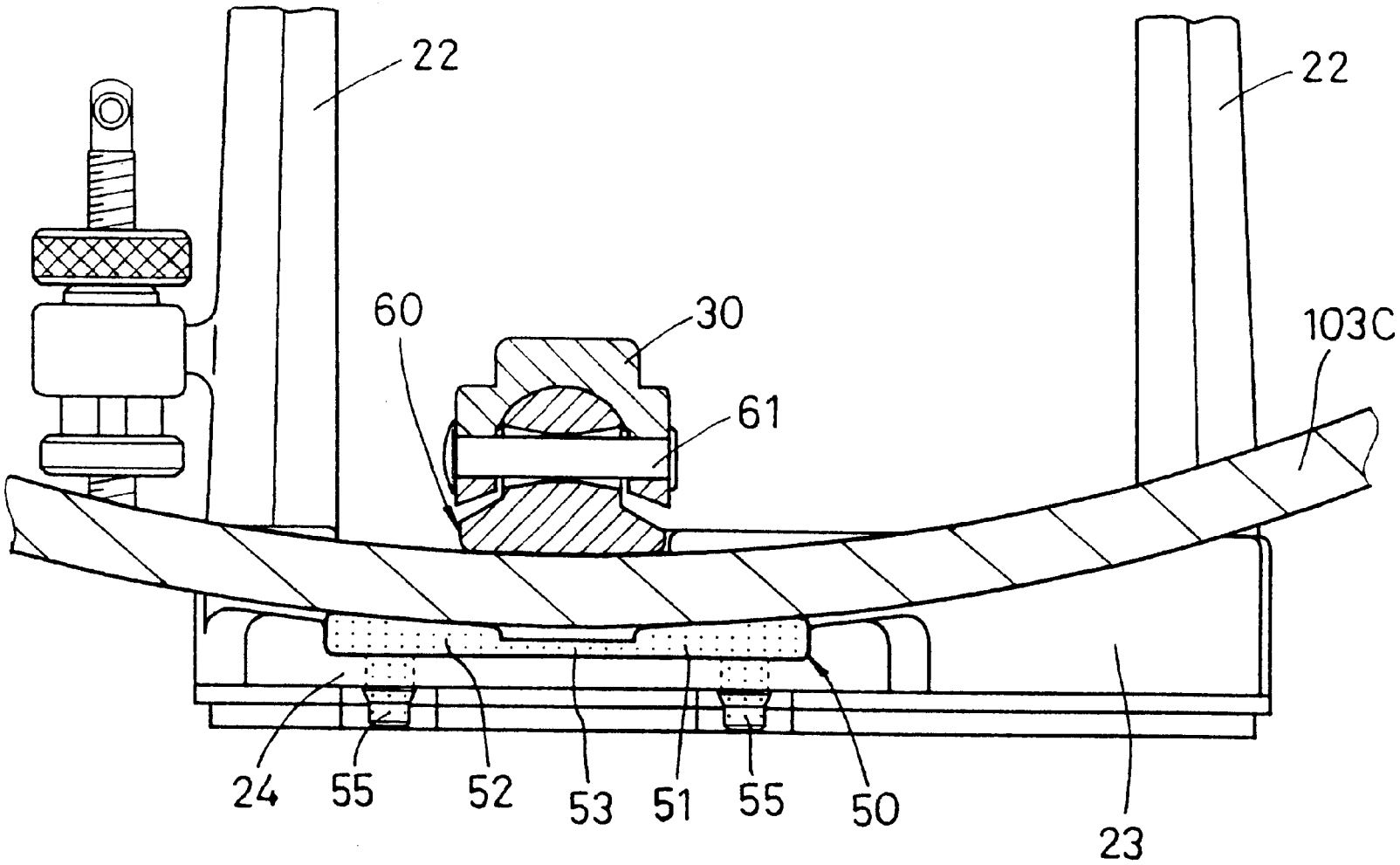
FIG. 7 is a front cross-sectional view of the hoop holding device in the state where a hoop that is rearwardly inclined is being clamped.
Figure 11A:
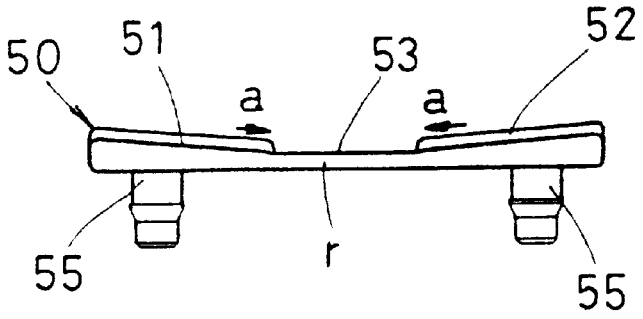
FIG. 11A is a front view.
Figure 11B:
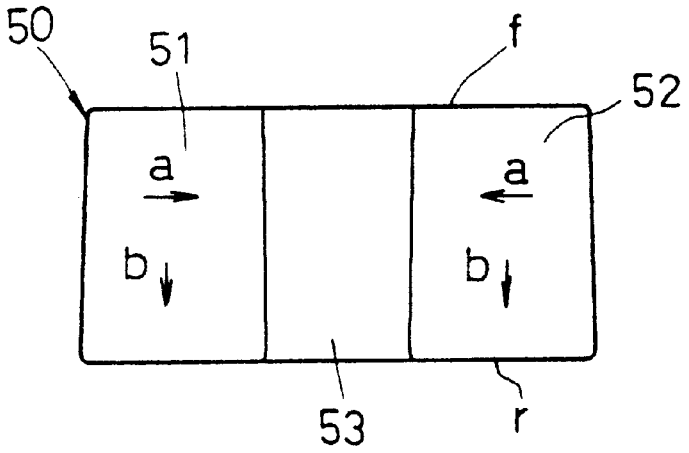
FIG. 11B is a top view.
Figure 11C:
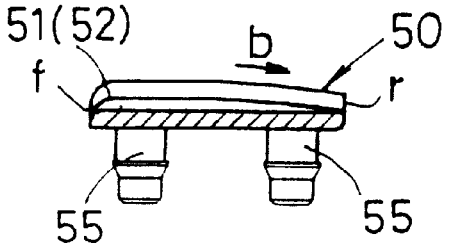
FIG. 11C is a side cross-sectional view at the middle thereof.

To avoid such a problem, an inclined holder 50 is formed on the hoop receiver 24. The inclined holder 50 supports elastic material inclined surfaces 51 and 52 so that the outer right and left sides may become gradually higher and the rear side, toward the performer, may become gradually lower, as shown in FIGS. 3, 7 and 11. As can be seen in FIG. 11, for both the left inclined surface 51 and the right inclined surface 52, the outside becomes gradually higher and the rear side becomes gradually lower on the right and left sides of the central lower portion 53 of the inclined holder 50 which is formed integrally with an elastic substance as rubber or plastic.

In FIG. 11, f indicates the front or the drum outward side, r indicates the rear or pedal side and arrows a and b indicate the incline direction, from higher to lower. An installation leg installs the incline holder 50 at the hoop receiver 24 of the support base 23.

Figure 8:
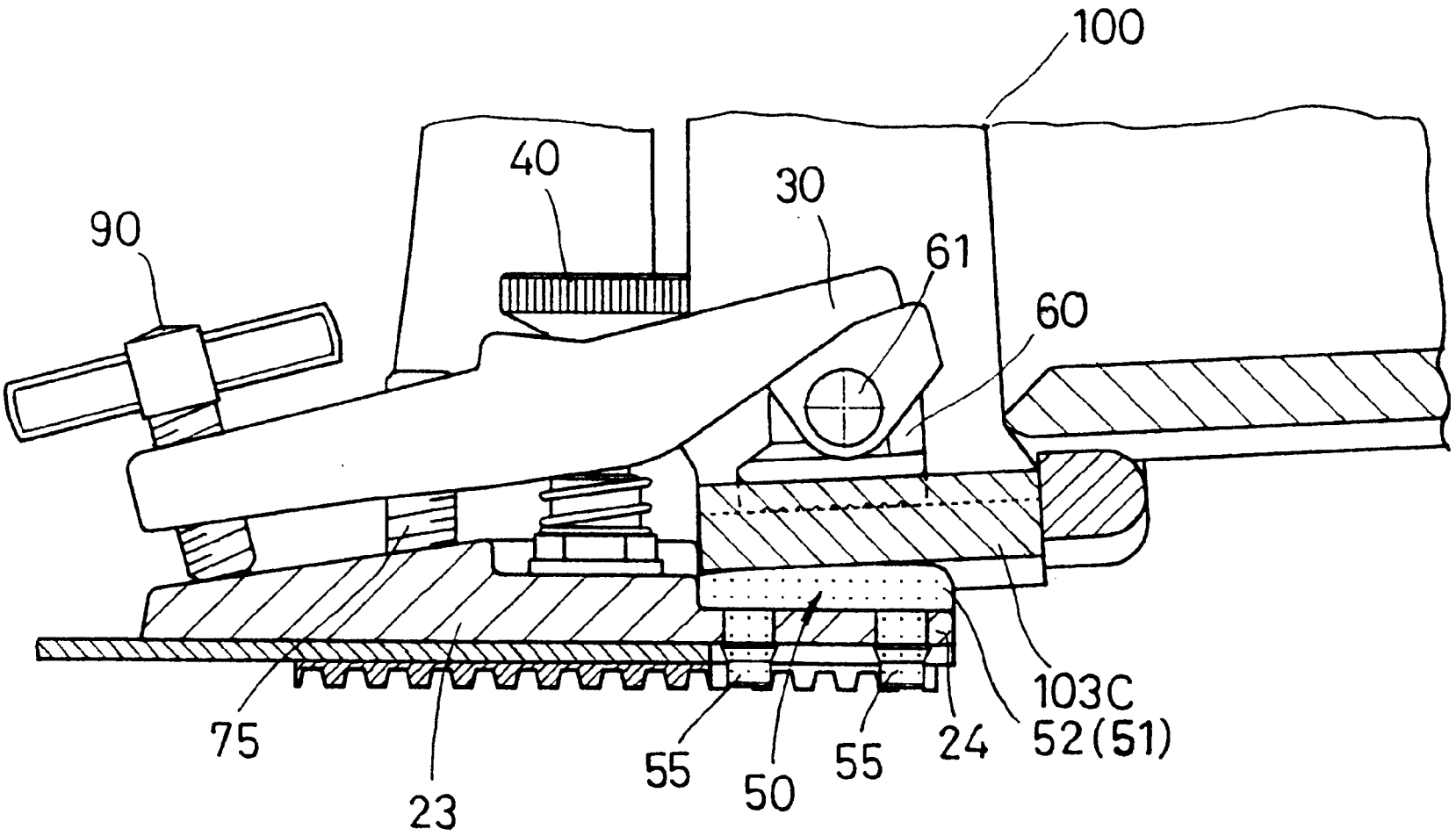
FIG. 8 is a side cross-sectional view of the hoop holding device.

FIG. 7 is a cross-section, viewed from the front, of the hoop holder where the hoop, in a rearwardly inclined state, is being clamped. FIG. 8 is also a cross-section of the hoop holding device, viewed from the side. The drum hoop 103C can be firmly clamped in its rearwardly inclined state by the inclined holder 50 that has been formed of an elastic substance even with the drum hoop 103C in the rearwardly inclined state, i.e., tilted toward the pedal side. There is no possibility for development of a twisting phenomenon in the hoop 103C, thereby eliminating the danger that the hoop or the base plate may be deformed or damaged.

In FIGS. 7 and 8, moreover, the holding jaw 60 at the front of the main hoop clamp body 30 is to move freely front and back and right and left in this example, for firmly clamping any incline of the drum hoop in cooperation with the structure of the inclined holder 50.

The holding jaw 60 is shown in FIG. 12. The holding jaw 60 is held by transverse axis shaft 61 at the lower front of the main hoop clamp body 30. A spherically curved concave recess 39 is formed at the lower front of the main hoop clamp body 30. The upper surface of the holding jaw 60 includes a spherically curved surface 62 that fits into the spherical concave 39.

Figure 12A:
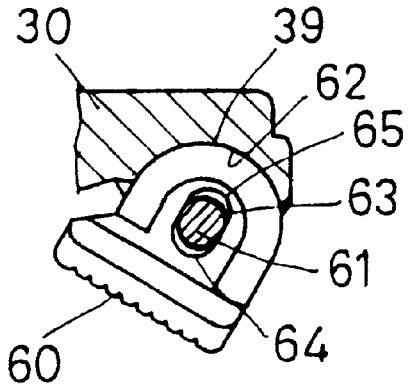
FIG. 12A shows the jaw swung forwardly from the drum head.
Figure 12B:
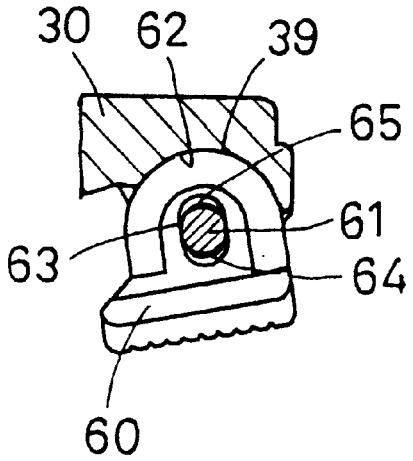
FIG. 12B shows the jaw swung rearwardly toward the drum head.
Figure 12C:
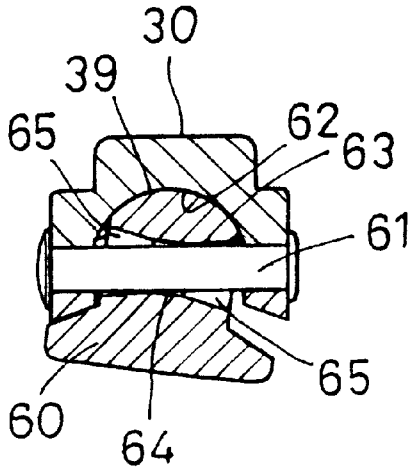
FIG. 12C is a front, cross-sectional view with the jaw swing to the left.
Figure 12D:
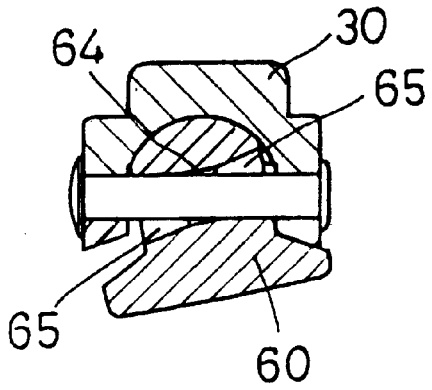
FIG. 12D is a view with the jaw swung to the right.

Moreover, the axial hole 63 through which the axis 61 of the holding jaw 60 extends is shaped such that the center of the axial hole 63 comprises the circular part 64 which is rotatable around the axis 61 and includes longitudinal holes 65 that gradually expand vertically outward from the central circular part toward the right and left sides, as in FIGS. 12C and 12D.

The holding jaw 60 is freely rotatable in the front and rearward directions of the main hoop clamp body 30, as shown in FIGS. 12A and 12B and is freely inclinable in the right and left directions of the main hoop clamp body 30 as is shown in FIGS. 12C and 12D. This enables the holding jaw 60 to firmly press the curved surface of a drum hoop at any incline.

Figure 2:
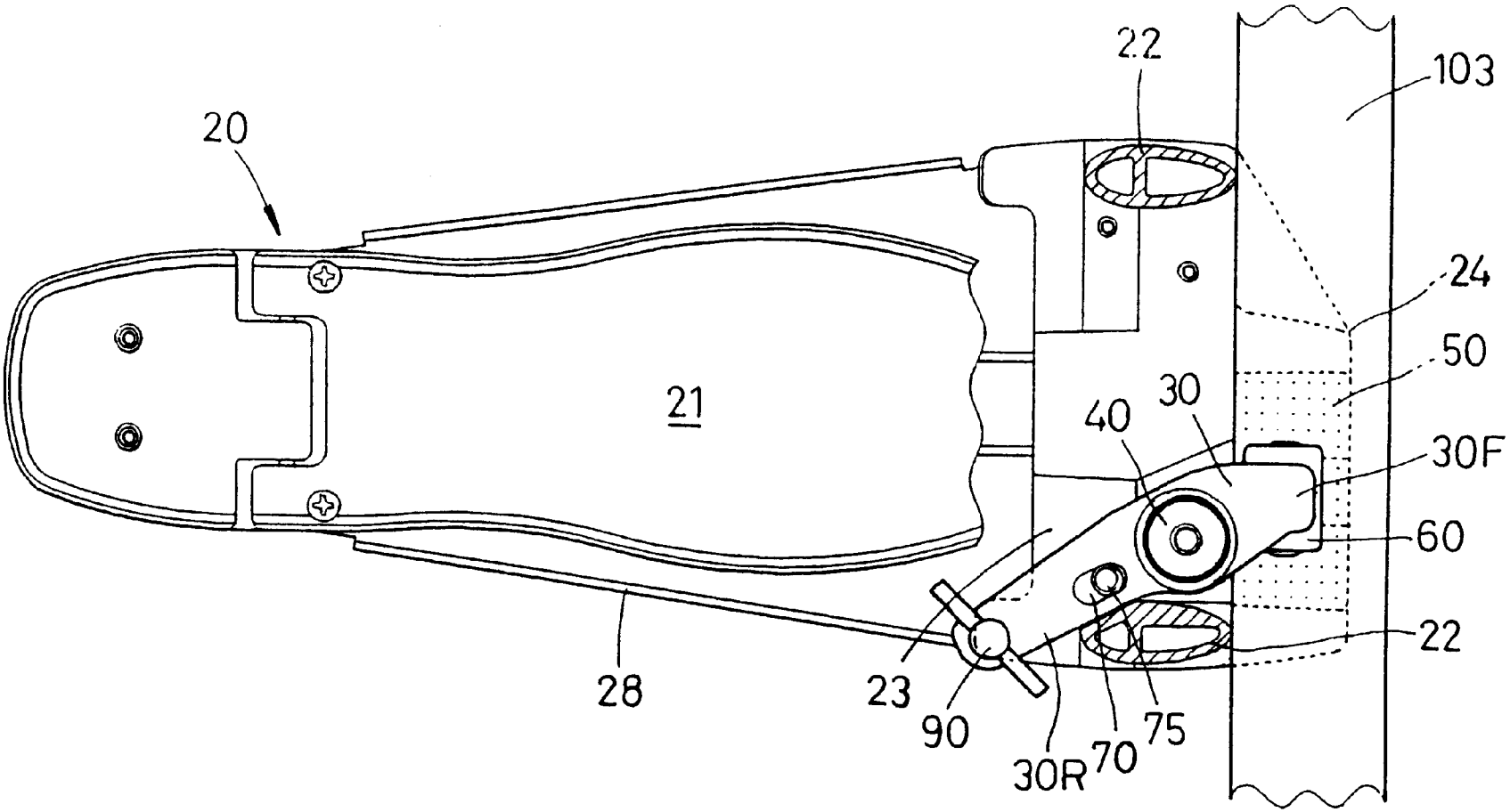
FIG. 2 is a view from above.

As seen in FIG. 2, the main hoop clamp body 30 has a front part 30F which is located on the front of the support base 23 and a rear part 30R which is arranged laterally outside the pedal plate 21 of the rear part of the support base 23.

In the known hoop holding device, a structure 40 presses the drum hoop between the holding jaw at the front of the main hoop clamp body and on the support base of the drum pedal, particularly the hoop receiving part at the front of the support base. The rear part of the main hoop clamp body is situated immediately below the drum pedal. The adjustment bolt has to be operated in a groping fashion by moving a hand in the narrow space immediately below the drum pedal, as was explained in connection with the prior art. This makes adjustment of the hoop holding device highly complicated and the set space is restricted. Consequently, it has been impossible to carry out free design work in terms of both mechanism and design.

With the invention, the front 30F of the main hoop clamp body 30 is still located on the front of the support base 23, as in the prior art hoop holder. At the same time, the rear part 30R of the main hoop clamp body 30 is arranged to be located laterally outside the area covered over by the pedal plate 21 and at the rear of the support base 23. This makes it possible to easily adjust the adjusting bolt 90 in a simple and accurate way. As the set space is not restricted, it becomes possible to carry out design work freely in terms of the mechanism involved and the design.

Since the main hoop clamp body 30 is capable of being adjusted at all angles in the back and forth directions, as compared with the support bolt 35, variations in the vertical positions of the rear part of the main hoop clamp body 30 can be small. As a result, there is no need to increase the length of the tightening bolt 90 that is screwed into the bore 31 at the rear of the main hoop clamp body 30, even when the thicknesses of the hoops 103A and 103B that are to be clamped may be quite different, as shown in FIGS. 5 and 6. This makes it possible to tighten it firmly and improves its operability.

The front part 30F of the main hoop clamp body 30 can secure the hoop by being located at the front of the support base 23. Since the rear part 30R of the main hoop clamp body 30 is located outside the pedal plate 21 at the rear of the support base 23, it is easy to accurately adjust the adjusting bolt 90 in a simple way, and the setting space is not restricted. As a consequence, the design work can be performed freely in terms of both mechanism and design.

The main hoop clamp body 30 may assume a bent form in the planar direction between its front 30F located at the front of the support base 23 and its rear outside the pedal plate 21 at the back of the support base 23. In such a case, the tightening force based on the tightening bolt 90 at the back of the main hoop clamp body 30 may not be sufficiently transmitted to the front. However, the seat 32 equipped with a concave surface 33 in the back and forth directions on the main hoop clamp body 30, coupled with the seat 32 being biased upwardly at all times by the spring 36, and from screwing an adjusting nut 40 having a concave surface part 42 inserted into the concave surface part 33 of the seat 32 against the support 35 that runs through the said seat 32, the tightening force based on the tightening bolt 90 can be effectively transmitted to the front of the main hoop clamp body 30 even when the main hoop clamp body 30 is bent.

A rotation prevention part 70 determines the pivoting movement inward of the foot pedal 21. The part 70 is formed on the main hoop clamp body 30. A stop 75 provided on the support base 23 is shown by FIGS. 2 and 3. It engages the rotation prevention part 70.

As shown, the rotation prevention part 70 comprises a rotation-stopping hole and the stop 75 comprises a pin extending in the hole. The hole 70 extends in the back and forth direction and is tapered to expand downward, as shown in FIG. 3, for the adjustment of the main hoop clamp body 30.

The rotation prevention part 70 and the stop 75 prevent the main hoop clamp 30 from moving or crawling beneath the pedal plate 21 due to vibrations or contacts, etc. The performer can perform with his mind at ease.

It is desirable to form the inclined holding part 50 having inclined surfaces 51 and 52 that will gradually rise toward the outer sides at the right and at the left and the part 50 also becomes lower toward the rear.

The hoop holding device for a drum pedal of the invention solves various problems experienced with the conventional bass drums.

The invention offers an operationally efficient device which is capable of firm clamping irrespective of the thickness of the drum hoop and without the need for an extended length tightening bolt. The hoop holding device is capable of accurate clamping without damaging the hoop or the base of the drum pedal even when the bass drum rear backwardly inclined, i.e., inclined toward the pedal.

The adjusting bolt can be operated without need for groping or sticking the performer's hand into the narrow space immediately below the pedal plate for adjusting the clamp and it enables free designing in terms of both mechanism and the design.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A hoop holding device for inclusion in a drum pedal for holding the hoop of a drum, the hoop holding device comprising:

a support base having a front area that is normally placed toward the drum;

a drum hoop receiver on the front area of the support base;

a hoop clamp body including a front part for being clamped over a drum hoop on the support base, the clamp body having a rear part away from the front part, the clamp body having a bottom side above the base and an opposite top side;

a through hole extending up from the support base through the clamp body between the front and the rear parts of the clamp body; a seat defined at the top side of the clamp body and communicating with the through hole;

a support bolt extending up from the support base through the through hole in the clamp body;

a spring for applying an upward force to the clamp body;

a nut tightenable onto the support bolt and against the top side of the clamp body for acting against the spring for setting the height of the clamp body on the support bolt, the nut being shaped for cooperating with the seat for enabling the adjustment of the tilt angle of the clamp body with respect to the support bolt for accommodating different thicknesses of drum hoop;

a tightening bolt at the rear part of the clamp body, tightenable with respect to the clamp body and also movable against a surface for urging the front part of the clamp body against the hoop with the clamp body supported between the nut and the spring at a particular height.

2. The hoop holding device of claim 1, wherein the seat at the top of the clamp body and the adjusting nut where it engages the seat have respective cooperatingly shaped surfaces that enable the tilt angle of the clamp body with respect to the support bolt to be adjusted to take account of the hoop thickness upon the nut being tightened on the support bolt against the seat on the clamp body.

3. The hoop holding device of claim 1, wherein the seat is generally concavely shaped in the front and rear directions providing clearance for movement of the clamp body with respect to the nut, and the nut has a cooperatingly shaped surface received at the concave seat so that the clamp body can be moved with respect to the nut and can be tightened at a selected tilt orientation of the clamp body with respect to the nut.

4. The hoop holding device of claim 1, further comprising a clamping jaw supported on the front part of the clamp body, the jaw being the part of the clamp body which clamps the hoop, the clamping jaw being supported for adjustment and orientation of the clamping jaw with respect to the clamp body to accommodate the shape and orientation of the drum hoop being clamped to the support base.

5. The hoop holding device of claim 1, wherein the hoop receiver on the front area of the support base has an inclined surface that gradually rises to the left and right, generally following the shape of the drum hoop and that is also inclined downwardly, generally toward the rear of the clamp body.

6. The hoop holding device of claim 5, wherein the holding part of the support base is comprised of elastic material on which the drum hoop is rested.

7. The hoop holding device of claim 5, further comprising a clamping jaw supported on the front part of the clamp body and the jaw being the part of the clamp body which clamps the hoop, the clamping jaw being supported for adjustment and orientation of the clamping jaw with respect to the clamp body to accommodate the shape and orientation of the drum hoop being clamped to the support base.

8. In combination a drum pedal and the hoop holding device of claim 1, wherein the drum pedal supports the hoop holding device, the drum pedal includes a pedal plate having a rear end supported to the support base and a front end that is movable up and down; a drum beater connected with the front end of the pedal for being moved by the pedal to beat a drum at the drum pedal; the pedal plate being so shaped and positioned and the clamp body being so placed that the front part of the clamp body is generally beneath the pedal plate while the clamp body is so oriented and extends so that the rear part thereof is positioned laterally outside and not under the pedal plate, sufficiently for providing easier access to the tightening bolt at the rear part on the clamping body.

9. A hoop holding device for inclusion in a drum pedal for holding the hoop of a drum, the hoop holding device comprising:

a support base having a front area that is normally placed toward the drum;

a drum hoop receiver on the front area of the support base, the hoop receiver has an inclined surface that gradually rises to the left and right, generally following the shape of the drum hoop and that is also inclined downwardly, generally away from the drum;

a hoop clamp body including a front part for being clamped over a drum hoop on the support base, the clamp body having a rear part away from the front part;

a through hole extending up from the support base through the clamp body between the front and the rear parts of the clamp body;

a support bolt extending up from the support base through the through hole in the clamp body;

a spring for applying an upward force to the clamp body;

a nut tightenable onto the support bolt and against the top side of the clamp body for acting against the spring for setting the height of the clamp body on the support bolt;

a tightening bolt at the rear part of the clamp body, tightenable with respect to the clamp body and also movable against a surface for urging the front part of the clamp body against the hoop with the clamp body supported between the nut and the spring at a particular height.

10. The hoop holding device of claim 9, further comprising a clamping jaw supported on the front part of the clamp body, the jaw being the part of the clamp body which clamps the hoop, the clamping jaw being supported for adjustment and orientation of the clamping jaw with respect to the clamp body to accommodate the shape and orientation of the drum hoop being clamped to the support base.

11. The hoop holding device of claim 9, wherein the holding part of the support base is comprised of elastic material on which the drum hoop is rested.

12. In combination a drum pedal and a hoop holding device, wherein the drum pedal supports the hoop holding device, the drum pedal includes a pedal plate having a rear end supported to the support base and a front end that is movable up and down; a drum beater connected with the front end of the pedal for being moved by the pedal to beat a drum at the drum pedal;

the hoop holding device comprising:

a support base having a front area that is normally placed toward the drum;

a drum hoop receiver on the front area of the support base;

a hoop clamp body including a front part for being clamped over a drum hoop on the support base, the clamp body having a rear part away from the front part;

a through hole extending up from the support base through the clamp body between the front and the rear parts of the clamp body;

a support bolt extending up from the support base through the through hole in the clamp body;

a spring for applying an upward force to the clamp body;

a nut tightenable onto the support bolt and against the top side of the clamp body for acting against the spring for setting the height of the clamp body on the support bolt;

a tightening bolt at the rear part of the clamp body, tightenable with respect to the clamp body and also movable against a surface for urging the front part of the clamp body against the hoop with the clamp body supported between the nut and the spring at a particular height;

the pedal plate being so shaped and positioned and the clamp body being so placed that the front part of the clamp body is generally beneath the pedal plate while the clamp body is so oriented and extends so that the rear part thereof is positioned laterally outside and not under the pedal plate, sufficiently for providing easier access to the tightening bolt at the rear part on the clamping body.

13. A hoop holding device for inclusion in a drum pedal for holding the hoop of a drum, the hoop holding device comprising:

a support base having a front area that is normally placed toward the drum;

a drum hoop receiver on the front area of the support base, the hoop receiver has an inclined surface that gradually rises to the left and right, generally following the shape of the drum hoop and that is also inclined downwardly, generally away from the drum;

a support bolt extending up from the support base through the clamp body;

a hoop clamp body including a front part for being clamped over a drum hoop on the support base, the clamp body having a rear part away from the front part;

a support bolt extending up from the support base through the clamp body;

a nut tightenable onto the support bolt and against the clamp body for setting the height of the clamp body on the support bolt;

a bolt cooperating with the clamp body for urging the front part of the clamp body to clamp on a drum hoop on the support base.

14. The hoop holding device of claim 13, further comprising a clamping jaw supported on the front part of the clamp body, the jaw being the part of the clamp body which clamps the hoop, the clamping jaw being supported for adjustment and orientation of the clamping jaw with respect to the clamp body to accommodate the shape and orientation of the drum hoop being clamped to the support base.

15. The hoop holding device of claim 13, wherein the holding part of the support base is comprised of elastic material on which the drum hoop is rested.

* * * * *